US007162873B2

(12) United States Patent
Levitin et al.

(10) Patent No.: US 7,162,873 B2
(45) Date of Patent: Jan. 16, 2007

(54) METHOD OF RUNNING A CONDENSER FOR LIQUIDATION OF STEAM OR VAPOR

(76) Inventors: Mikhail Levitin, P.O. Box 102, Reeders, PA (US) 18352; Boris Khaytin, P.O. Box 102, Reeders, PA (US) 18352

( * ) Notice: Subject to any disclaimer, the term of this patent is extended or adjusted under 35 U.S.C. 154(b) by 0 days.

(21) Appl. No.: 09/808,962

(22) Filed: Mar. 16, 2001

(65) Prior Publication Data

US 2002/0129605 A1 Sep. 19, 2002

(51) Int. Cl.
*F01K 17/00* (2006.01)

(52) U.S. Cl. ..... 60/686; 60/685

(58) Field of Classification Search ..... 60/685, 60/686, 690

See application file for complete search history.

(56) References Cited

U.S. PATENT DOCUMENTS 1,296,412 A * 3/1919 Levinsen ..... 60/686
3,454,491 A * 7/1969 Colburn ..... 210/662
4,193,781 A * 3/1980 Vogel et al. ..... 62/81
4,231,229 A * 11/1980 Willitts ..... 62/196.2
4,471,622 A * 9/1984 Kuwahara ..... 60/686 X
4,753,077 A * 6/1988 Rosenblatt ..... 60/686 X
5,005,351 A * 4/1991 Archer ..... 60/686
5,079,929 A * 1/1992 Alsenz ..... 62/117
5,261,249 A * 11/1993 Manz et al. ..... 62/149
5,385,202 A * 1/1995 Drosdziok et al. ..... 165/1
5,485,754 A * 1/1996 Harpster ..... 73/861.04
5,488,828 A * 2/1996 Brossard ..... 60/675

* cited by examiner

*Primary Examiner*—Hoang Nguyen

(57) ABSTRACT

The present invention relates to a system in which a process of condensing steam or vapor is used for cooling or heating an ambient environment. An increase in the effectiveness of the condensing process is achieved by adjusting the input of steam or vapor into the condenser.

8 Claims, 2 Drawing Sheets

METHOD OF RUNNING A CONDENSER FOR LIQUIDATION OF STEAM OR VAPOR

BACKGROUND OF THE INVENTION

The increased efficiency of the preservation of food and medical products substantially affected human longevity and the quality of life. To satisfy the demand for an effective and inexpensive method of preserving large amounts of products an efficient and reliable thermal control system is required. Using the condensing processes wherein steam is condensed in heating systems or different vapors, for example refrigerant vapor, are condensed in cooling systems has effectively satisfied many of these needs.

It is known that in the case of an interruption in the input of vapor or steam into a condenser a liquid film, which covers the heat exchanging space, is formed during condensation. The resistance to the heat exchange from one media to another is increased. Accordingly, the method of input of steam or vapors to the condenser is an important factor in the effectiveness of the condensation process. At the beginning of the process it is necessary to condense the greatest amount of vapor or steam. Some time later this quantity of vapor or steam is reduced because of the decreasing rate of heat transferring into the cooling or heating system. The final step of the process requires some reduction of the input of vapor or steam. To increase the effectiveness of the condensing process an adjustment is needed in the input of steam or vapor into the condenser.

Accordingly, a need exists for improving the input of vapor or steam into the condenser. A need also exists to increase the effectiveness of the heat transfer in the condenser between vapor or steam and the temperature exchanging media.

SUMMARY OF THE INVENTION

According to the present invention the optimum function of a condenser during the process of condensation can be achieved through the use of a controlling device, which is installed on the steam or vapor input line. That controlling device is handled by the pressure controller, which compares the value of the pressure of steam or vapor input to the condenser with the value assigned in the set point adjuster. When the controlling device is opened a portion of the steam or vapor enters into the condenser and the pressure in the steam or vapor input line is reduced. If the controller which compares the value of the pressure of steam or vapor input into the condenser with the value assigned in the set point adjuster registers that the value is equal to the set point, it closes the controlling device. At the same time when the controlling device is closed, the pressure in the steam or vapor input line is increased. If the value of the pressure of steam or vapor in the input line becomes equal to the assigned value in the set point adjuster, the controlling device is opened.

According to the second embodiment of the present invention the temperature controller compares the value of the temperature of condensation in the steam or vapor input line to the temperature in the condenser. When the controlling device is opened, a portion of steam or vapor enters the condenser and the pressure is reduced in the steam or vapor input line of the condenser. The temperature controller compares the temperature of the condenser in a steam or vapor input line to the temperature level assigned in the set point adjuster. If that value is equal to the set point the controlling device is closed. At the same time when the controlling device is closed, the temperature is increased in the steam or vapor input line. If the temperature of the steam or vapor in the input line becomes equal to the temperature level assigned in the set point adjuster, the controlling device is opened.

According to the third embodiment of the present invention the pressure controller compares the value of the pressure of the condensation being drawn off from the condenser with the value assigned at the set point adjuster. A portion of steam or vapor enters the condenser through the open controlling device installed on the steam or vapor input line of the condenser. The pressure is increased in the line drawing off the condensation from the condenser. The pressure controller compares the value of the pressure in the line drawing off the condensation from condenser to the value assigned in the set point adjuster. If that value is equal to the set point, the controlling device is closed. At the same time when the controlling device is closed the pressure is reduced in the line drawing off the condensation from the condenser. If the value of the pressure in the line drawing off the condensation from the condenser becomes equal to the value assigned in the set point adjuster, the controlling device is opened.

According to the fourth embodiment of the present invention the temperature controller compares the temperature of condensation in the line drawing off from the condenser with the temperature level assigned in the set point adjuster. A portion of steam or vapor enters the condenser through the open controlling device installed on the steam or vapor input line of the condenser. The temperature is increased in the line drawing off the condensation from the condenser. The temperature controller compares the temperature in the line drawing off the condensation from the condenser to the value assigned in the set point adjuster. If that value is equal to the set point, the controlling device is closed. At the same time when the controlling device is closed, the temperature is reduced in the line drawing off condensation from the condenser. If the temperature in the line becomes equal to the temperature level assigned in the set point adjuster, the controlling device is opened.

ue to the interrupted character of the input of vapor or steam into the condenser, the film of condensation on the heat exchanging space is thinner than in existing systems or totally disappears. Therefore, the resistance to the heat transferring process is reduced and the effectiveness is increased. In addition, a deep sub-cooling process of condensation is achieved, so that the energy of steam or vapor is used more efficiently. In the case of condensing vapor of refrigerant, the sub-cooling increases the effectiveness of refrigeration to a significant degree.

The above described and many other features and attendant advantages of the present invention will become apparent as the invention becomes better understood by reference to the following detailed description when considered in conjunction with the accompanying drawing.

DESCRIPTION OF THE DRAWING

A detailed description of the preferred embodiment of the invention will be made with reference to the accompanying drawing.

DETAILED DESCRIPTION OF THE DRAWING

The following is a detailed description of the best presently known mode of carrying out the invention. This description is not being taken in a limiting sense, but is made merely for the purpose of illustrating the general principles of the invention. The scope of the invention is defined by the appended claims.

Figure 1:
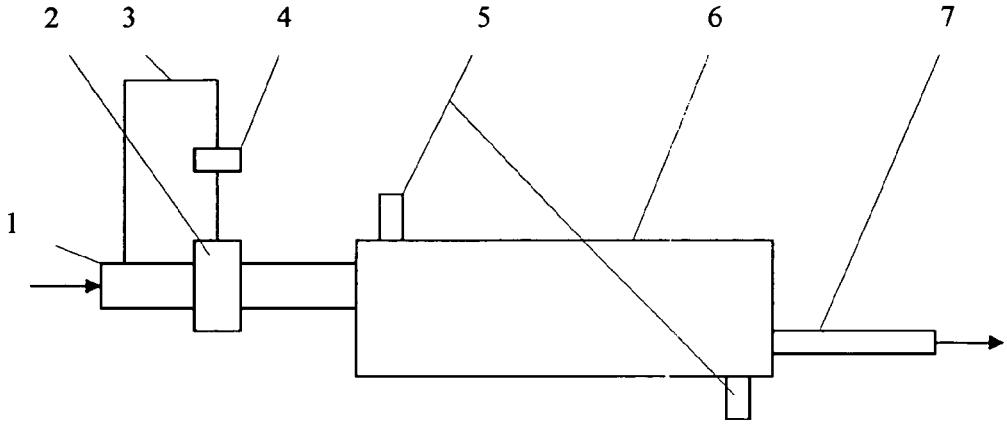
FIG. 1 shows a condenser unit in accordance with preferred embodiment of the present invention.

The condenser 6 (see FIG. 1) with pipes 5 for the flow of cooling media is connected to steam or vapor input line 1 and discharges the condensation through line 7, a controlling device 2 with set point adjuster is installed on said line 1, a pressure controller 4 is connected to line 1 by link 3 and connected to the controlling device 2. When a portion of steam or vapor enters the condenser 6 through the open controlling device 2, the pressure in steam or vapor input line 1 is reduced. The pressure controller 4 compares the value of the pressure of steam or vapor input to the condenser 6 with the value assigned in the set point adjuster and, if that value is equal to the set point, it closes the controlling device 2. At the same time when the controlling device 2 is closed, the pressure in steam or vapor input line 1 is increased. If the value of the pressure of steam or vapor in said line 1 becomes equal to the value assigned in the set point adjuster, the controlling device 2 is opened.

Figure 2:
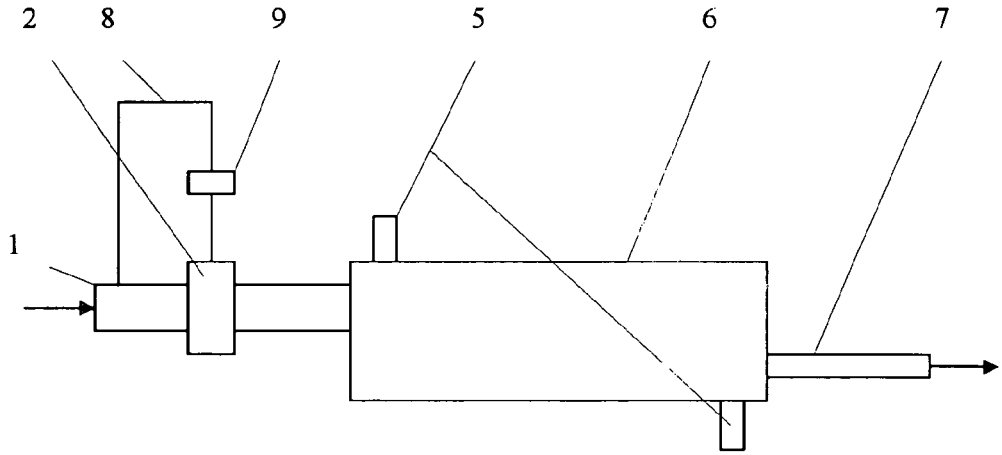
FIG. 2 shows a condenser unit in accordance with the second embodiment of the present invention.

According to the second embodiment of the present invention the condenser 6 (see FIG. 2) with pipes 5 for the flow of cooling media is connected to steam or vapor input line 1 and discharges the condensation through line 7, a controlling device 2 with set point adjuster is installed on said line 1, a temperature controller 9 is connected to the line 1 by link 8 and is connected to the controlling device 2. When a portion of steam or vapor enters the condenser 6 through the open controlling device 2, the temperature in steam or vapor input line 1 is reduced. The temperature controller 9 compares the temperature level of steam or vapor input to the condenser 6 with the value assigned in the set point adjustment and, if the value is equal to the set point, closes the controlling device 2. At the same time when the controlling device 2 is closed, the temperature in said steam or vapor input line 1 is increased. If the value of the temperature of steam or vapor in said line 1 becomes equal to the value assigned in the set point adjustment, the controlling device 2 is opened.

Figure 3:
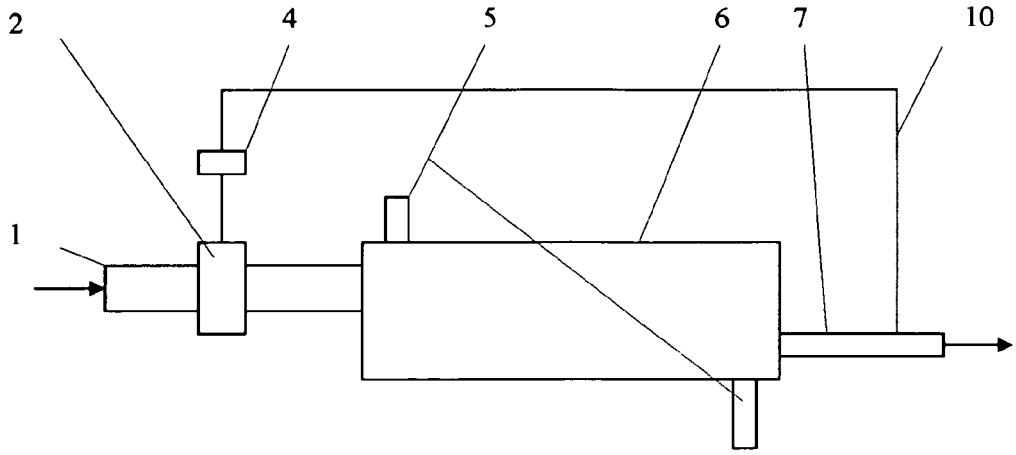
FIG. 3 shows a condenser unit in accordance with the third embodiment of the present invention.

According to the third embodiment of the present invention the condenser 6 (see FIG. 3) with pipes 5 for the flow of cooling media is connected to steam or vapor input line 1 and discharges the condensation through line 7, a controlling device 2 with set point adjuster is installed on said line 1, a pressure controller 4 is connected to line 7 by link 10 and connected to the controlling device 2. When a portion of steam or vapor enters the condenser 6 through the open controlling device 2, the pressure in steam or vapor input line 1 is reduced. The pressure controller 4 compares the value of the pressure of condensation discharged from the condenser 6 with the value assigned in the set point adjuster and, if that value is equal to the set point, closes the controlling device 2. At the same time when the controlling device 2 is closed, the pressure in line 7 is reduced and the condensation from the condenser 6 is discharged off If the value of the pressure of the condensation in said line 7 becomes equal to the value assigned in the set point adjuster, the controlling device 2 is opened.

Figure 4:
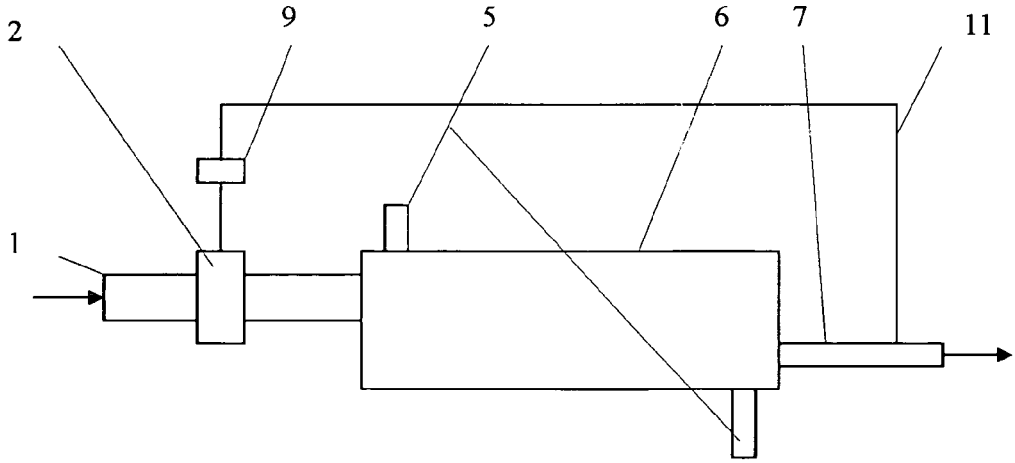
FIG. 4 shows a condenser unit in accordance with the fourth embodiment of the present invention.

According to the fourth embodiment of the present invention the condenser 6 (see FIG. 4) with pipes 5 for the flow of cooling media is connected to line 1 and discharges the condensation through line 7, a controlling device 2 with set point adjuster is installed on said line 1, a temperature controller 9 is connected to the line 7 by link 11 and connected to the controlling device 2. When a portion of steam or vapor enters the condenser 6 through the open controlling device 2, the temperature in steam or vapor input line 1 is reduced. The temperature controller 9 compares the temperature level of the condensation discharged from the condenser 6 with the value assigned in the set point adjuster and, if that value is equal to the set point, closes the controlling device 2. At the same time when the controlling device 2 is closed, the temperature in said line 7 is reduced and the condensation from the condenser 6 is discharged. If the value of the temperature of the condensation in said line 7 becomes equal to the value assigned in the set point adjustment, the controlling device 2 is opened.

Although the present invention has been described in terms of the preferred embodiment above, numerous modification and/or additions to the above-described preferred embodiment would be readily apparent to one skilled in the art. It is intended that the scope of the present invention extends to modifications and/or additions and that the scope of the present invention is limited solely by the claims set forth below.

What is claimed:

1. A method of running a condenser for liquidation of steam or vapors having pipes and which are connected to the steam or vapor input line and to the line discharging condensation from said condenser, a controlling device installed on said steam or vapor input line, a pressure controller connected by a link to said steam or vapor input line and electrically connected to said controlling device, said method comprising of the repeating in cycles in the following steps:

close said controlling device when pressure of the steam or vapor in said steam or vapor input line is reduced;

open said controlling device when pressure of steam or vapor in said steam or vapor input line is increased;

input a portion of steam or vapor into condenser through open said controlling device.

2. A method of running a condenser for liquidation of steam or vapors, said condenser having pipes and connected to a steam or vapor input line and to a line discharging off condensation from said condenser, a controlling device installed on said steam or vapor input line, a temperature controller connected by a link to said steam or vapor input line and electrically connected to said controlling device, said method comprising of the repeating in cycles following steps:

close said controlling device when temperature of the steam or vapor is reduced in the steam or vapor input line, open said controlling device when temperature of steam or vapor is increased in the steam or vapor input line, input a portion of steam or vapor into condenser through said open controlling device.

3. A method of running a condenser for liquidation of steam or vapors having pipes and connected to steam or vapor input line and to a line discharging condensation from said condenser, a controlling device installed on said steam or vapor input line, a pressure controller connected by a link to said line discharging condensation from said condenser and electrically connected to said controlling device, said method comprising of repeating in cycles the following steps:

close said controlling device when pressure of the steam or vapor is increased in said line discharging condensation from said condenser;

open said controlling device when pressure of steam or vapor is reduced in said line discharging condensation from said condenser;

input a portion of steam or vapor into condenser through said open controlling device.

4. A method of running a condenser for liquidation of steam or vapors, said condenser having pipes and which is also connected to a steam or vapor input line and to a line discharging condensation from said condenser, a controlling device installed on said steam or vapor input line, a temperature controller connected by a link to said line discharging condensation from said condenser and electrically connected to said controlling device, said method comprising of repeating in cycles the following steps:

close said controlling device when temperature of condensate is increased in said line discharging condensation from said condenser;

open said controlling device when temperature is reduced in said line discharging condensation from said condenser;

input a portion of steam or vapor into condenser through open said controlling device.

5. A condenser for liquidation of steam or vapors having pipes and connected to a steam or vapor input line and a line discharging off condensation from said condenser, a pressure controller being connected to a link between said steam or vapor inlet and said controlling device, said pressure controller being electrically connected to said controlling device, said pressure controller closes the controlling device when the pressure of the steam or vapor input line is reduced, opens the controlling device when the pressure in said steam or vapor input line is increased to regulate the input of steam or vapor into the condenser.

6. A condenser for liquidation of steam or vapors having pipes and connected to a steam or vapor input line and a line discharging off condensation from said condenser, a temperature controller being connected to a link between said steam or vapor inlet and said controlling device, said temperature controller being electrically connected to said controlling device, said temperature controller closes the controlling device when the temperature of the steam or vapor input line is reduced, opens the controlling device when the temperature in said steam or vapor input line is increased to regulate the input of steam or vapor into the condenser.

7. A condenser for liquidation of steam or vapors having pipes and connected to a steam or vapor input line and a line discharging off condensation from said condenser, a pressure controller being connected to a link between said line discharging off condensation and said controlling device, said pressure controller being electrically connected to said controlling device, said pressure controller closes the controlling device when the pressure of the condensation discharging line is reduced, opens the controlling device when the pressure in said condensation discharging line is increased to regulate the input of steam or vapor into the condenser.

8. A condenser for liquidation of steam or vapors having pipes and connected to a steam or vapor input line and a line discharging off condensation from said condenser, a temperature controller being connected to a link between said line discharging off condensation and said controlling device, said temperature controller being electrically connected to said controlling device, said temperature controller closes the controlling device when the temperature of the condensation discharging line is reduced, opens the controlling device when the temperature in said condensation discharging line is increased to regulate the input of steam or vapor into the condenser.

* * * * *